US008029172B2

(12) United States Patent
Levon

(10) Patent No.: US 8,029,172 B2
(45) Date of Patent: Oct. 4, 2011

(54) SYSTEM AND METHOD FOR ILLUMINATION OF LEVITATING BODIES

(76) Inventor: Leif Levon, Alta (SE)

( * ) Notice: Subject to any disclaimer, the term of this patent is extended or adjusted under 35 U.S.C. 154(b) by 0 days.

(21) Appl. No.: 12/218,995

(22) Filed: Jul. 21, 2008

(65) Prior Publication Data

US 2009/0207621 A1 Aug. 20, 2009

(51) Int. Cl.
*F21V 21/00* (2006.01)

(52) U.S. Cl. ..... 362/398; 362/253; 362/806

(58) Field of Classification Search ..... 362/253, 362/327, 339, 363, 311.13, 398, 806, 809; 446/131, 129, 132, 133
See application file for complete search history.

(56) References Cited

U.S. PATENT DOCUMENTS

| | | | | |
|---|---|---|---|---|
| 3,325,935 | A * | 6/1967 | Holter | 40/407 |
| 4,309,746 | A * | 1/1982 | Rushworth | 362/363 |
| 5,410,463 | A * | 4/1995 | Jean et al. | 362/398 |
| 6,135,601 | A * | 10/2000 | Frucht | 362/301 |
| 6,361,192 | B1 * | 3/2002 | Fussell et al. | 362/810 |
| 6,976,768 | B2 * | 12/2005 | Hewson | 362/241 |
| 2003/0095409 | A1 * | 5/2003 | Cheng | 362/253 |
| 2008/0200092 | A1 * | 8/2008 | Chung | 446/131 |

* cited by examiner

*Primary Examiner* — Y My Quach Lee

(57) ABSTRACT

A system is provided for illuminating a levitating body, the system may include a base that has a light source, and a body that levitates over the base. The levitating body may have a bottom surface and an upper surface. The bottom surface may have at least one aperture to receive light from the stationary body. The levitating body may have internal transmissive surfaces to reflect and scatter the light throughout the levitating body to produce visual decorative displays.

2 Claims, 8 Drawing Sheets

SYSTEM AND METHOD FOR ILLUMINATION OF LEVITATING BODIES

CLAIM OF PRIORITY UNDER 35 U.S.C. 119

The present application for patent claims priority, based upon the Paris Convention for the Protection of Industrial Property and the World Trade Organization, to Swedish Patent and Registration Office Application No. 0702749-3 entitled "Illumination of Hovering Objects," filed Dec. 12, 2007, which is hereby expressly incorporated by reference herein.

BACKGROUND

1. Field

This invention is generally related to decorative levitating objects, and, more particularly, is related to systems and methods for lighting levitating objects.

2. Background of the Invention

The invention relates to a system and method for illumination of levitating bodies to produce visual displays and decorative effects. Decorative visual displays are common and widely used in households and business. They are used to create a pleasant and ambient environment and they may also be used for advertising purposes. Examples include U.S. Pat. No. 6,382,808, by Lin, entitled "Decorative lighting device having floating member," and U.S. Patent Application No. 2006/0087642, entitled "Polariscope toy and ornament with accompanying photoelastic and/or photoplastic devices," which are entirely incorporated herein by reference.

Common systems for illuminating levitating bodies use magnetic properties. For example, a stationary body may have a first magnet and a levitating body may include a secondary magnet, where the magnets are configured to repulse each other to cause the levitating body to float over the stationary body. The stationary body may include a light source to illuminate the levitating body.

One problem with prior art systems is that the secondary magnet in the levitating body tends to block the light and reduce the amount of light received by the levitating body. Another problem is that light may be reflected sharply from the levitating body causing glare and discomfort in the eyes of the beholder. An additional problem is that the levitating body may have only limited intense and bright light distributed throughout the body.

Other systems use batteries and or diodes in the levitating body to produce energy and light. As a result, the levitating body is typically heavy and only floats a few inches above the stationary body. Batteries and diodes are not durable and may break and fall apart. A further problem with all these systems is the lack of bright and intense lights inside the levitating body.

Accordingly, a system and method for illuminating levitating body is needed to address these problems with the prior art systems.

SUMMARY OF THE INVENTION

The objects mentioned above, as well as other objects, are solved by the present invention, which overcomes disadvantages while providing new advantages not previously obtainable in the prior art.

In a preferred embodiment, a system is provided for illuminating a levitating body, the system may include a base that has a light source; and a body that levitates over the base. The levitating body may have a bottom surface and an upper surface. The bottom surface may have at least one aperture to receive light from the stationary body. The levitating body may have internal transmissive surfaces to reflect and scatter the light throughout the levitating body to produce visual decorative displays.

Alternative embodiments may include a levitating body that tapers from the bottom surface toward the upper surface so as to enable collection of light at a point at the upper surface, such as an apex.

Alternative embodiments may also include a levitating body that has an upper surface that terminates with an optical element for refracting light to produce visual effects. The body may also include lenses for refracting light to produce visual effects.

Another embodiment may include a base that has some magnetic properties and includes a light source and a levitating body that has some magnetic properties configured to interact with the magnetic properties of the base to enable the body to levitate over the base. The levitating body may have transmissive surfaces for receiving and reflecting the light throughout the body to produce visual decorating displays.

Another embodiment may include a base that has a transmitting energy source and a levitating body floating over the base. The body includes a light source powered by the transmitted energy, and the body may have transmissive surfaces for reflecting and scattering the light to produce visual decorative displays.

A further embodiment may include a method for illuminating a floating body, the method comprising the steps of providing a base, providing a light source attached the light source to the base, providing a floating body that has transmissive surfaces, transmitting the light inside the floating body, and transmitting and scattering the light by the transmissive surfaces to generate visual display effects.

Other systems, methods, features, and advantages of the present invention will be, or will become, apparent to one having ordinary skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The novel features which are characteristic of the invention are set forth in the appended claims. The invention itself however, together with further objects and attendant advantages thereof, will be best understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout several views.

DETAILED DESCRIPTION

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 1A:
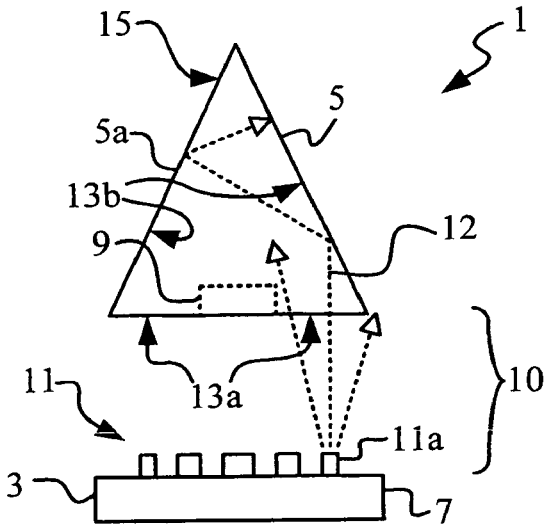
FIG. 1A is a side view of an embodiment of the present invention showing a system for illumination of a levitating body, the system may include a magnetic system that includes a base with a base magnet and a levitating magnet associated with a generally pyramidal levitating structure.

FIG. 1A is a side view of an embodiment of the present invention showing a system for illumination of a levitating body 1, the system 1 may include a base 3 and a levitating structure 5, such as the generally pyramidal levitating structure 5*a* illustrated. System 1 may include a levitation system that may include a base magnet 7 associated with, and/or acting as, base 3, and a levitating magnet 9 associated with levitating structure 5*a*, that may be separated by gap 10. Levitating magnet 9 may be, for example, a permanent magnet. The levitation system uses the interaction between base magnet 7 and levitating magnet 9 to cause levitating structure 5*a* to levitate over, or near, base 3. Although shown as a magnetic levitation system, other systems, or combinations of systems, may be used to maintain levitating structure 5*a* in a levitated state over, or near, base 3, such as but not limited to forced air systems, electromagnetic systems, chemical systems, fuel cell systems, mechanical systems, and other levitation systems known to those having ordinary skill in the art.

Figure 12:
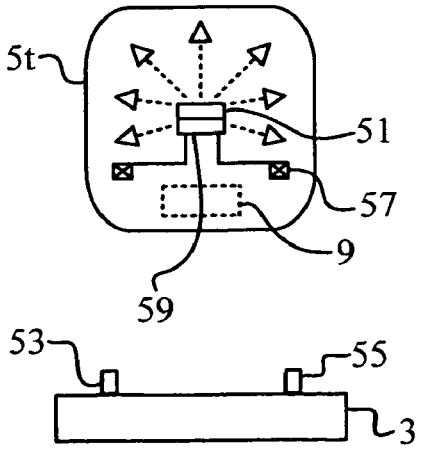
FIG. 12 is a side view of an alternative embodiment of the present invention showing a system for illumination of a levitating body, the system including a generally cubical levitating structure having a wireless light source.

Although shown as a generally pyramidal levitating form in FIG. 1A, structure 5 may be formed in a number of desirable shapes for directing light 12, such as but not limited to globular, conical, cylindrical, and other shapes, as will be apparent to those having ordinary skill in the art. Levitating structure 5 may be formed with a variety of internal and external reflective surfaces, and suitable light conductors, and may be made of a variety of materials. Levitating structure 5 may be illuminated by a light source, for example a base light source 11 as illustrated in FIG. 1A, which may be part of base 3, and may be positioned below levitating structure 5. The light source may also be incorporated into levitating structure 5, for example, as illustrated in FIG. 12, where wireless light source 51 is shown. A levitating light source, such as wireless light source 51, may include its own energy source or it may be supplied through an exterior energy source.

Varying the shape of levitating structure 5, may enhance the visual display of the system for illumination of a levitating body 1. Levitating structure 5 may include a light transmissive portion 13*a*, through which light 12 is generally able to travel unimpeded, and a light directing portion 13*b* that may include reflective and/or focusing surfaces. A tapering tip 15 of the generally pyramidal levitating structure 5*a* may be cut obliquely, horizontally or in any other manner, as illustrated by example in the accompanying drawings. The term transmissive includes transparent surfaces, semi-transparent surfaces, mirrors, two way mirrors, reflective surfaces, refractive surfaces, diffusive surfaces and absorptive surfaces.

Figure 1B:
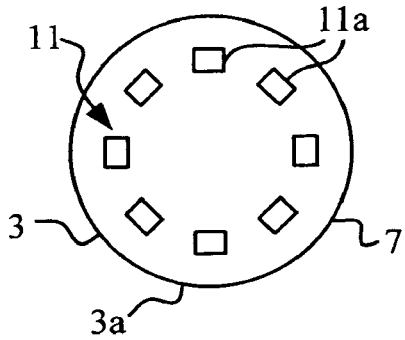
FIG. 1B is a top view of the base of FIG. 1A.

FIG. 1B is a top view of base 3 that illustrates that base 3 may be a circular base 3*a*. Circular base 3*a*, as illustrated, may include base magnet 7 and base light source 11. Base light source 11 may include a plurality of luminaires 11*a* that may shine light 12 from below levitating structure 5. As is shown in FIG. 1B, the plurality of luminaries 11*a*may be arranged to optimize light 12 in any desired fashion, such as in a crown formation, to correspond to, and coordinate with, light transmissive portion 13*a*, that may be, for example, a ring-like light transmissive portion 13*a*, as illustrated in FIGS. 1A and 1B. Light 12 from light source 11 may be collected within tapering tip 15 of structure 5 to generate a variety of decorative effects. Visible light may be used as well as light outside the visible spectrum, such as ultra-violet and infrared light to visible light.

Figure 2:
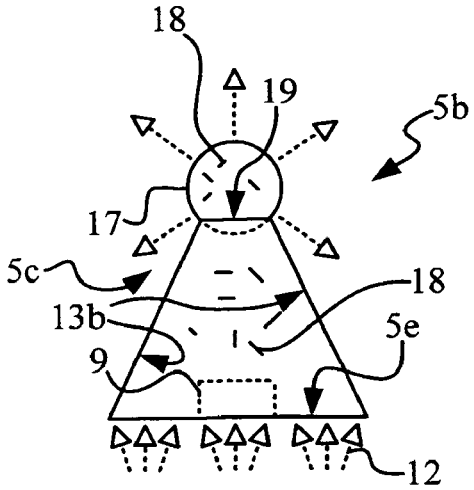
FIG. 2 is a side view of another alternative embodiment of the levitating structure, the levitating structure having a globular light dispersing portion associated with an aperture.

FIG. 2 is a side view of another alternative embodiment of the levitating structure 5*b*. Levitating structure 5*b* illustrates a levitating structure 5 having a globular light dispersing portion 17 associated with an aperture 19. As is illustrated in FIG. 2, and further illustrated in additional figures, an aperture, such as aperture 19, may be created at or near the upper end 5*c* of levitating structure 5, for example, alternative embodiment 5*b* of levitating structure 5. At or within aperture 19, objects with suitable or desired form or other refractive, reflective or light transmitting properties may be secured or positioned. For example, in FIG. 2, where globular light dispersing portion 17 is shown at aperture 19 of upper end 5*c* of levitating structure 5*b*.

Light, collected by the levitating structure 5*b*, may be directed toward globular light dispersing portion 17, which in turn may refract and/or reflect, to generate a pleasant decorative effect. Levitating structure 5 may be designed to enable one or more optical effects when struck by light 12, for example, from light source 11 (FIG. 1A). Therefore, levitating structure 5 may be formed from more or less light 12 transmissive materials, depending upon the desired effect. Globular light dispersing portion 17 may also include reflective inclusions 18 and/or other reflective surfaces, shavings, voids, and pieces of diffractive prisms and glass for further enhancing the desired effect. Similarly, other portion of levitating structure 5 may also include reflective inclusions 18, reflective surfaces, shavings, voids, and pieces of diffractive prisms and glass may be added to produce a variety of visual display effects. Light 12 transmitting, fluorescent, and/or phosphorescent material may also be used to accomplish a variety of effects. Combining tapering tip 15 with a suitable body structure may enhance overall luminosity of levitating structure 5.

Levitating structure 5*b* may be illuminated at or near its lower portion 5*e* by divergent rays of light 12, approaching half a sphere, ensuring good internal illumination. Through levitating structure 5*b*, globular light dispersing portion 17 may be elevated to a more desired and attractive visual level, for example, further from base 3, and further from gap 10.

In addition to the globular form illustrated in FIG. 2, other shapes may be associated with aperture 19 such as, but not limited to polyhedras. Such bodies may be composed of a number of smaller partially plane surfaces, creating a multitude of refracting and reflecting effects, further promoting its decorativeness. Objects of various sizes, shapes and materials may be exhibited in this manner. For example, precious or semi precious gemstones or jewelry, such as rhomboids, drop shapes, ellipsoid and prisms, may be employed.

Figure 3:
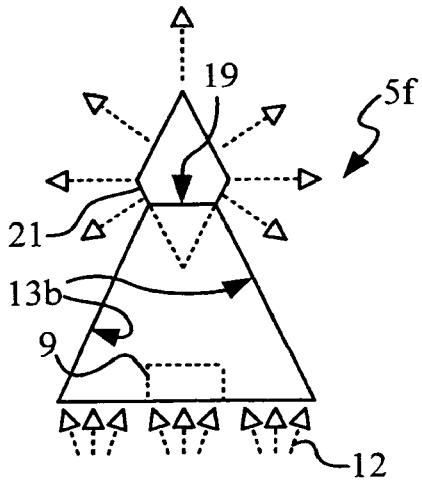
FIG. 3 is a side view showing a further alternative embodiment of the levitating structure, the levitating structure having a diamond shaped light dispersing portion associated with an aperture.

FIG. 3 is a side view showing a further alternative embodiment of the levitating structure 5*f*. Levitating structure 5*f* shows a levitating structure 5 having a diamond shaped light dispersing portion 21 associated with aperture 19.

Figure 4:
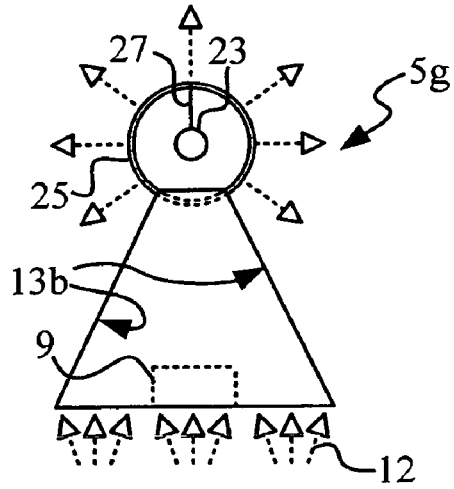
FIG. 4 is a side view showing an additional alternative embodiment of the levitating structure having a generally spherical light dispersing portion housed within a generally hollow light transmitting container.

FIG. 4 is a side view showing an additional alternative embodiment of the levitating structure 5*g*. Levitating structure 5*g* has a generally spherical light dispersing portion 23 housed within a generally hollow light transmitting container 25. Generally hollow light transmitting container 25 may be seated in aperture 19. Generally spherical light dispersing portion 23 may be suspended by a fastener 27 from generally hollow light transmitting container 25.

Figure 5A:
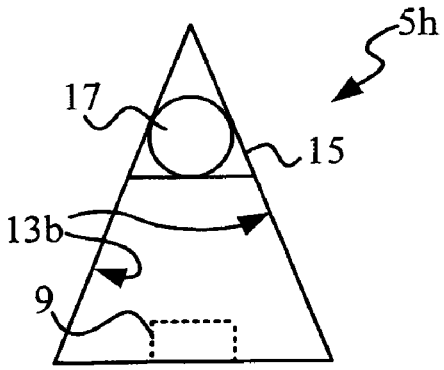
FIG. 5A and FIG. 5B are side views of an additional alternative embodiment of the levitating structure having a globular light dispersing portion housed within, and towards the apex of, a generally pyramidal form.
Figure 5B:
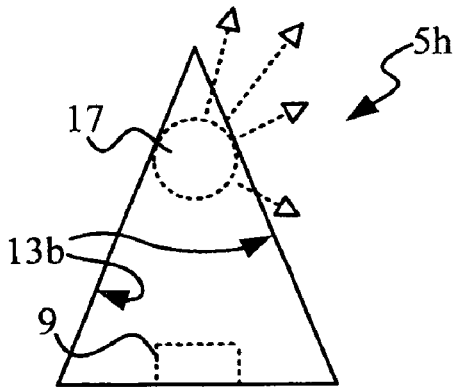

Still further embodiments of levitating structure 5 follow. FIG. 5A and FIG. 5B are side views of an additional alternative embodiments of the levitating structure 5*h* having globular light dispersing portion 17 housed within, and towards the tapering tip 15 of the generally pyramidal form of levitating structure 5*h*.

Figure 6A:
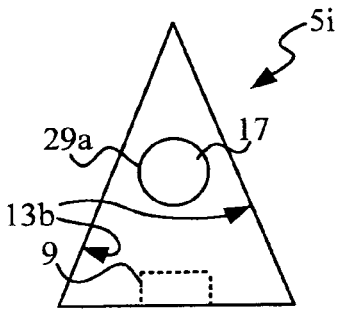
FIG. 6A and FIG. 6B are side views of an additional alternative embodiment of the levitating structure having a globular light dispersing portion housed within a central portion of a generally pyramidal form.
Figure 6B:
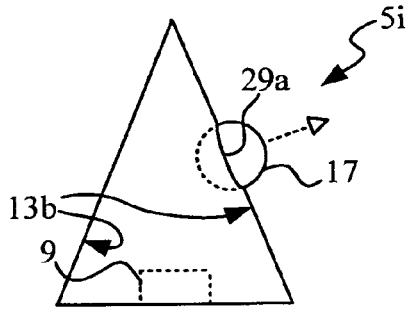

FIG. 6A and FIG. 6B are side views of an additional alternative embodiment of the levitating structure 5*i* having globular light dispersing portion 17 housed within a central portion of one face of the generally pyramidal form of levitating structure 5*i*. Globular light dispersing portion 17 may partially project from at least one opening 29*a* on the one face.

Figure 7A:
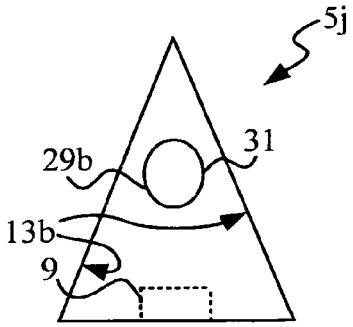
FIG. 7A and FIG. 7B are side views of an additional alternative embodiment of the levitating structure having an ellipsoid light dispersing portion housed within a central portion of a generally pyramidal form.
Figure 7B:
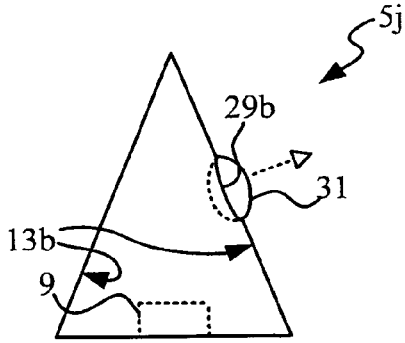

FIG. 7A and FIG. 7B are side views of an additional alternative embodiment of the levitating structure 5*j* having an ellipsoid light dispersing portion 31 housed within a central portion of one face of the generally pyramidal form of levitating structure 5*j*. Ellipsoid light dispersing portion 31 may partially project from at least one opening 29*b* on the one face.

As is illustrated, levitating structure 5 may be associated with a variety of light 12 display devices, including those light 12 refracting objects illustrated, such as globular light dispersing portion 17 and ellipsoid light dispersing portion 31.

Figure 8A:
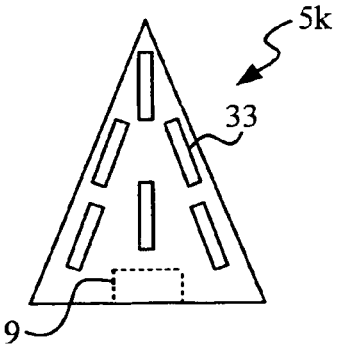
FIG. 8A, FIG. 8B, and FIG. 8C show side views of additional alternative embodiments of the levitating structure having a generally pyramidal form and having, respectively, along one or more walls, elongated apertures or slits, decorative round apertures, and alphabetic letter characters.
Figure 8B:
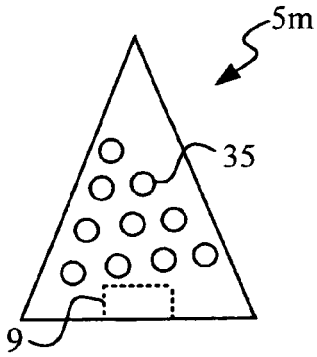
Figure 8C:
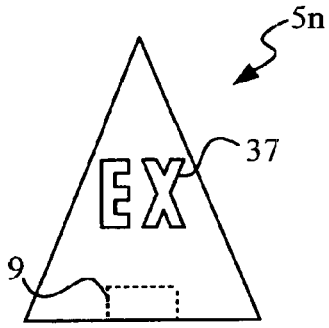

FIG. 8A, FIG. 8B, and FIG. 8C show side views of additional alternative embodiments of the levitating structure 5*k*, 5*m*, and 5*n*, respectively. Levitating structures 5*k*, 5*l* and 5*m* may have generally pyramidal forms and may have, respectively, along one or more walls, elongated apertures or slits 33, decorative round apertures 35, and alphabetic letter characters 37.

FIG. 8A, FIG. 8B, and FIG. 8C illustrate that a simple decorative effect may be generated by carving out a plurality of openings, such as elongated apertures or slits 33, decorative round apertures 35, and alphabetic letter characters 37 along one or more surfaces of structure 5. Elongated apertures 33 may resemble vertical slits or any other desired shapes. These openings may be simple puncture holes, or craved furrows which may be folded outward, extending part of the light directing portion 13*b* of levitating structure 5, wrapping formed flaps round openings edges, or onto part of any attached light 12 emitting object, allowing even further reflection of light.

Figure 9:
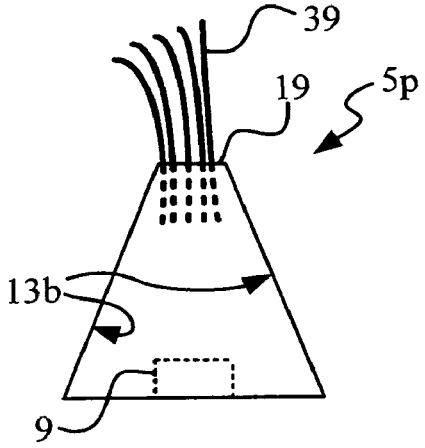
FIG. 9 is a side view showing a further alternative embodiment of the levitating structure, the levitating structure having light transmitting strands and/or fiber optic fibers.

FIG. 9 is a side view showing a further alternative embodiment of the levitating structure 5*p*. Levitating structure 5*p* may have a pyramidal shape and may have light transmitting strands 39 and/or fiber optic fibers, extending through, or associated with, aperture 19.

Figure 10:
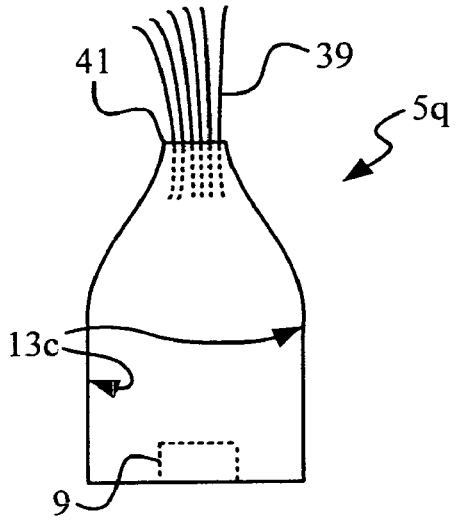
FIG. 10 is side view of an alternative embodiment of the levitating structure, the levitating structure having a generally bottle shaped form and light transmitting strands and/or fiber optic fibers.

FIG. 10 is a side view showing a further alternative embodiment of the levitating structure 5*q*. Levitating structure 5*q* may have a bottle shape and may have light transmitting strands 39 and/or fiber optic fibers, extending through, or associated with, aperture 41. Levitating structure 5*q* may also have a light directing portion 13*c* that may include reflective and/or focusing surfaces.

Figure 11A:
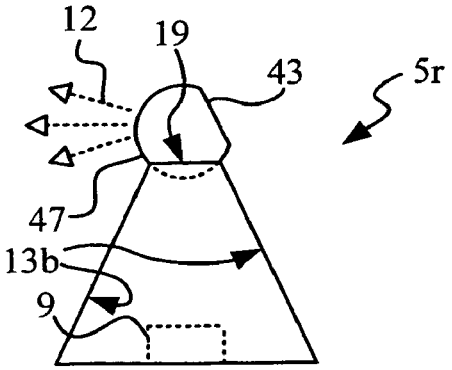
FIG. 11A and FIG. 11B are side views of further alternative levitating structures having a generally pyramidal form and having, respectively, a mirrored reflective surface and an inverted cup shaped translucent hollow structure.
Figure 11B:
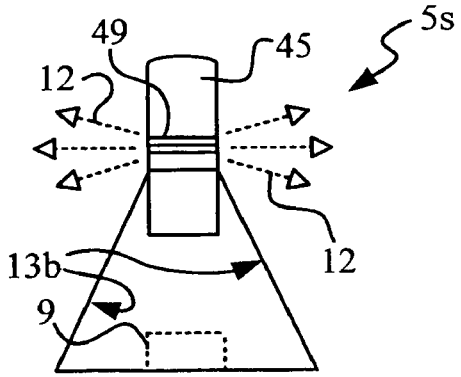

FIG. 11A and FIG. 11B are side views of further alternative embodiments of levitating structures 5*r*, 5*s* having a generally pyramidal form and having, respectively, a mirrored reflective surface 43 and an inverted dome-shaped translucent hollow structure 45. As illustrated, mirrored reflective surface 43 may be shaped as an obliquely cut sphere 47 with refractive and/or reflective features, and may be fitted into aperture 19. As illustrated, light 12 may be reflected from mirrored reflective surface 43. Inverted dome-shaped translucent hollow structure 45 may include an area of concentrated rays 49 to produce an intense light 12 display.

FIG. 12 is a side view of an alternative embodiment of the present invention showing a system for illumination of a levitating body, the system including a generally cubical levitating structure 5*t* having a wireless light source 51. As illustrated, embodiments may include internal illumination sources for levitating structure 5, such as diodes or wireless inductive energy or any other forms of energy. Wireless light source 51 may be associated with a primary coil 53 that may be located in or on base 3. Alternating current may be supplied to primary coil 53, for example 1 kHz, from a supply source 55, to produce, or induce, an electric current in secondary coil 57 in levitating structure 5. Secondary coil 57 may be connected to a control circuit 59 to supply power to wireless light source 51.

Figure 13:
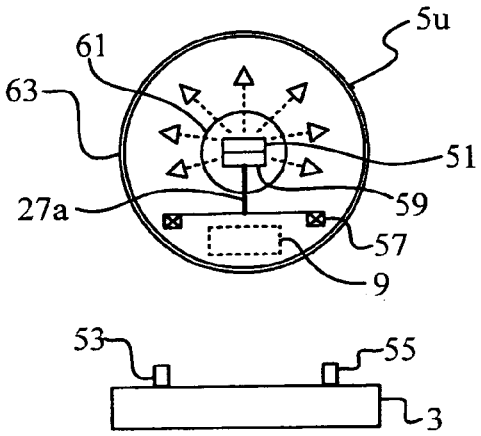
FIG. 13 is a side view of an alternative embodiment of the present invention showing a system for illumination of a levitating body, the system including a generally spherical levitating structure having a wireless light source.

FIG. 13 is a side view of an alternative embodiment of the present invention showing a system for illumination of a levitating body, the system including a generally spherical levitating structure 5*u* having a wireless light source 51. Levitating structure 53*a* may include a smaller light transmitting body 61 that may be enclosed within an outer shell 63. Wireless light source 51 and control circuit 59 may be connected to secondary coil 57 through a tether 27*a*.

Figure 14:
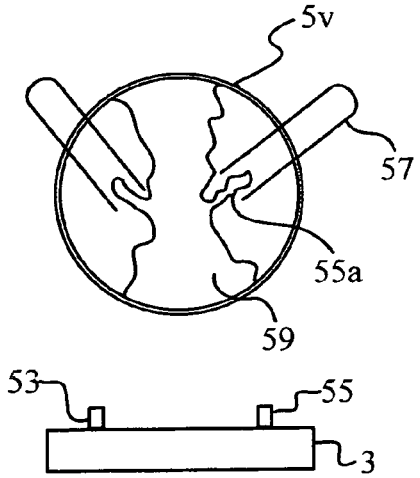
FIG. 14 is a side view of an alternative embodiment of the present invention showing a system for illumination of a levitating body, the system including a generally spherical levitating structure having luminous rods extending from the spherical portion.

FIG. 14 is a side view of an alternative embodiment of the present invention showing a system for illumination of a levitating body, the system including a generally spherical levitating structure 5*v* having a wireless light source 55*a* and having one or more luminous rods 57 extending from the spherical portion 59 of the structure 5*v*. Wireless light source 55*a* may be, for example, one or more light diodes that may pierce body the spherical portion 59 as shown in FIG. 14. Alternative embodiments may include high energy transference to illuminate other light 12 sources, such as incandescent light bulbs.

Figure 15A:
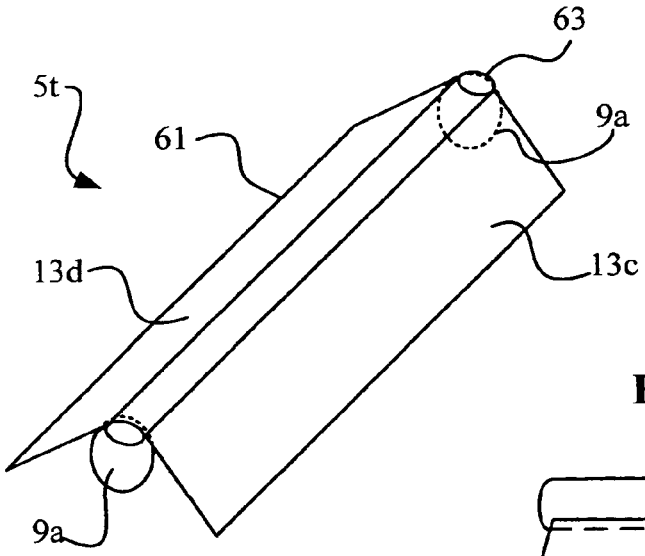
FIG. 15A and FIG, 15B show perspective and side views, respectively, of an alternative embodiment of the present invention showing a system for illumination of a levitating body, the system including a levitating body having a generally A-frame shaped roof form having a cylindrical light dispersing portion.
Figure 15B:
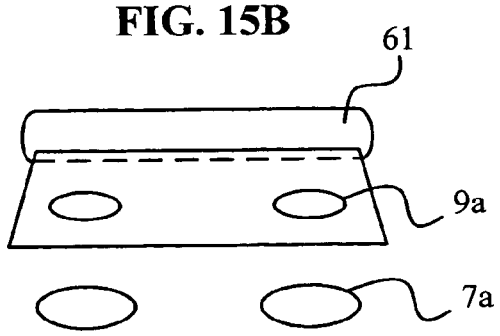

FIG. 15A and FIG. 15B show perspective and side views, respectively, of an alternative embodiment of the present invention showing a system for illumination of a levitating body, the system including a levitating structure 5*t* having a generally A-frame shaped roof 61, having a cylindrical light dispersing portion 63, and light directing portions 13*c* and 13*d* that may include reflective and/or focusing surfaces, and may include oblong tapering internally reflecting walls. Levitating structure 5*t* may be include one or more levitating magnets 9*a* that may interact with one or more base magnets 7*a* to cause levitating structure 5*t* to levitate.

Figure 16:
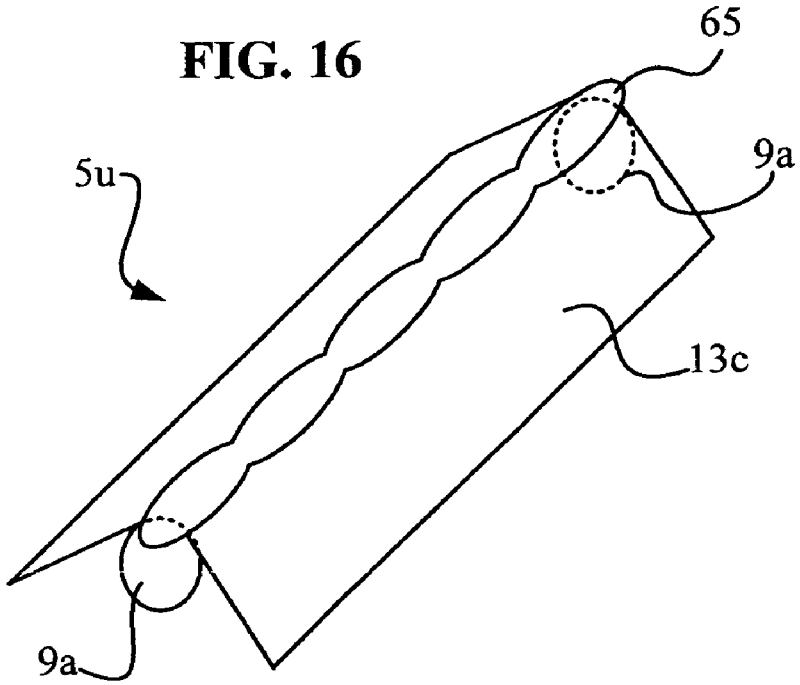
FIG. 16 shows a perspective view of an additional embodiment of the levitating structure having a generally A-frame shaped roof form fitted with an assortment of light dispersing shapes.

FIG. 16 shows a perspective view of an additional embodiment of the levitating structure 5*u* having a generally A-frame shaped roof form that may be fitted with an assortment of light dispersing shapes 65, such as but not limited to beads, ellipsoids, ovoids or other lenses or beads.

Figure 17:
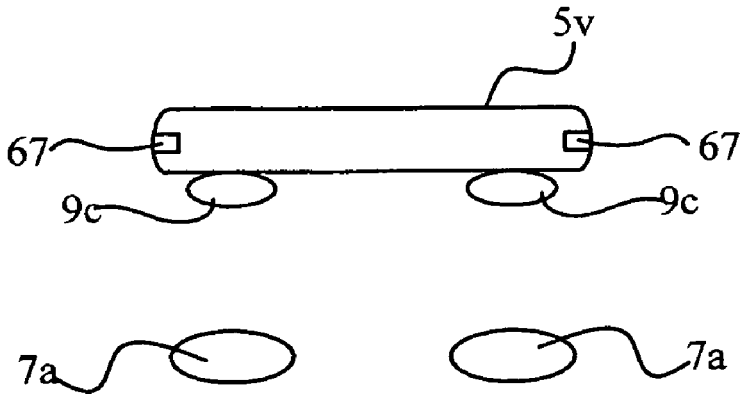
FIG. 17 is a side view of an alternative embodiment of the present invention showing a system for illumination of a levitating body, the system including a generally cylindrical levitating structure having a plurality of light sources towards the ends of the levitating structure.

FIG. 17 is a side view of an alternative embodiment of the present invention showing a system for illumination of a levitating body, the system including a generally cylindrical levitating structure 5*v* having a plurality of light sources 67 positioned towards the ends of levitating structure 5*v*. Light sources 67 may be diodes, or other light sources known to those having ordinary skill in the art. Levitating structure 5*v* may be include one or more levitating magnets 9*c* that may interact with one or more base magnets 7*a* to cause levitating structure 5*v* to levitate.

Figure 18:
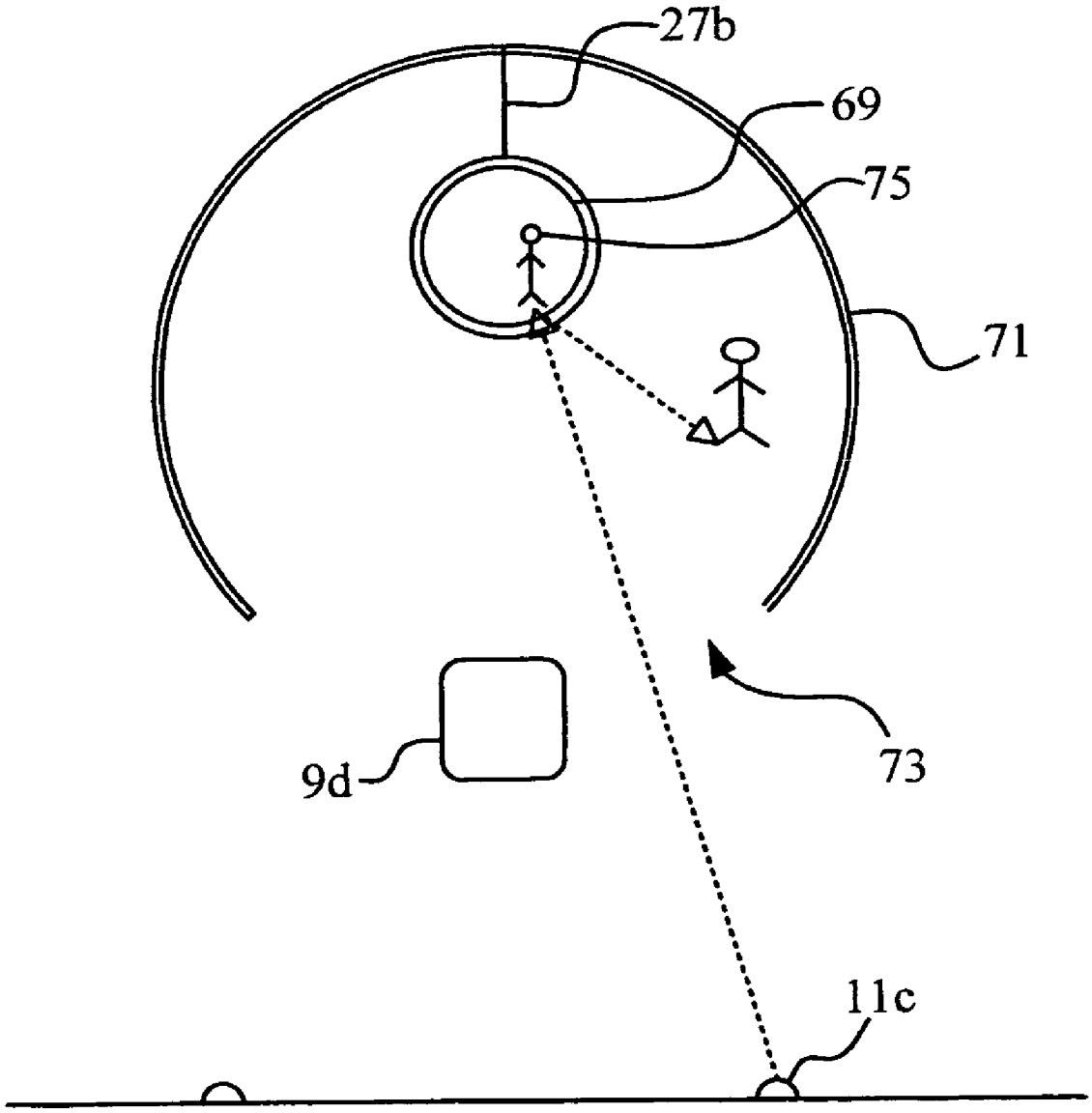
FIG. 18 shows schematically an alternative embodiment of the present invention showing a system for illumination of a levitating body, the system including light dispersing structure housed within a projecting surface structure.

FIG. 18 shows schematically an alternative embodiment of the present invention showing a system for illumination of a levitating body, the system including a light dispersing structure 69 housed within a projecting surface structure 71. Projecting surface structure 71 may be a globe shaped body having an aperture 73 that may be positioned opposite a light source 11*c*, and kept afloat by means of magnetic element 9*d* interacting with other opposite magnetic elements, not shown. Light dispersing structure 69 may be placed inside projecting surface structure 71. Projecting surface structure 71 may be clear and/or colored. Light dispersing structure 69 may be suspended by a fastener 27*b* to allow light dispersing structure 69 to be mobile to scatter lights inside projecting surface structure 71. Light dispersing structure 69 may be made of any light 12 reflective or transmissive materials, and/or may include reflective fields 75 showing texts, figures, and/or combinations. The surface of light dispersing structure 69 may be made of any desired materials and colors to produce desired visual color effects. Images may be reflected from light dispersing structure 69 onto projecting surface structure 71 and may appear slightly enlarged to a spectator when viewed from outside.

Figure 19A:
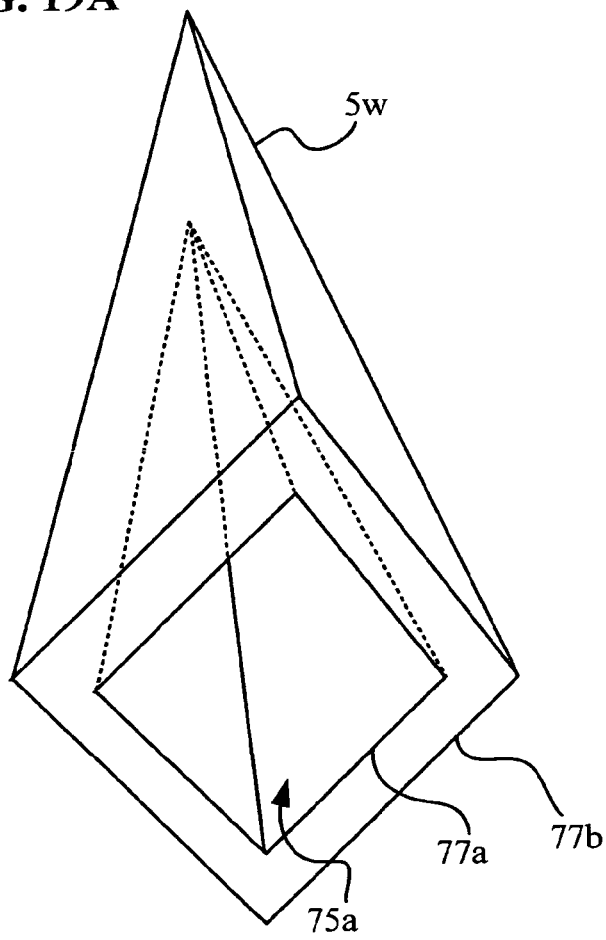
FIG. 19A and FIG. 19B show perspective views of additional alternative embodiments of the levitating structure having two-way wall mirrors or reflectors.
Figure 19B:
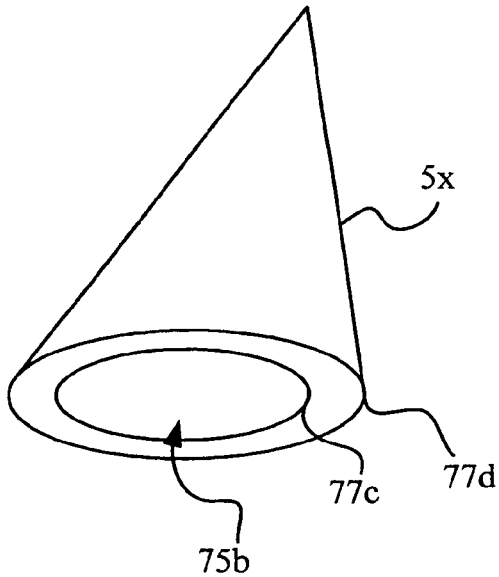

FIG. 19A and FIG. 19B show perspective views of additional alternative embodiment of the levitating structure 5, levitating structures 5*w* and 5*x* respectively, having apertures 75*a* and 75*b*, respectively, to receive light 12 from light source 11 (see FIG. 1A). Levitating structures 5*w* and 5*x* may include two-way mirrored walls 77*a*, 77*b*, 77*c*, and 77*d*. The two-way mirrored walls 77*a*, 77*b*, 77*c*, and 77*d* may allow light 12 to both penetrate and partially reflect. Light 12 entering between walls 99*a* and 99*b*, and between walls 99*c* and 99*d*, will partly exit, and partly be internally reflected, generating pleasant visual displays and a depth sensation to an observer. A two way mirror wall configuration may be generally incorporated into levitating object bodies so that spectators may enjoy three dimensional light 12 shows. A combination of partition walls may be employed. Pyramidal or conical exterior bodies may be divided by such two-way reflecting system. Spirally or helically shaped two way mirrors will appear to an observer as if light 12 rays are stemming from multiple light sources.

The above description is not intended to limit the meaning of the words used in the following claim that define the invention. For example while preferred embodiments involving devices adapted to control speed of rotating speakers and method of using these devices have been described above, persons of ordinary skill in the art will understand that a variety of other designs still falling within the scope of the following claims may be envisioned and used. It is contemplated that future modifications in structure, function, or result will exist that are not substantial changes and that all such insubstantial changes in what is claimed are intended to be covered by the claims.

I claim:

1. An illumination system comprising:

(a) a base;

(b) a light source attached to the base; the base having magnetic properties and (c) a levitating body over the base the body having at least one magnetic element interacting with the magnetic properties of the base to enable the body to levitate over the base, the body having semi-transparent surfaces, the body having a bottom surface and an upper surface, the bottom surface having an aperture receiving light and wherein the semi-transparent surfaces reflect and scatter the light to produce visual decorative displays, the semi-transparent surface of the body tapers from the bottom surface toward the upper surface so as to enable collection of light at a point at the upper surface, and the upper surface terminates with an optical element comprised of lenses refracting light to produce visual effects.

2. An illumination system for illuminating a levitating body, the system comprising:

(a) a base having a light source, the base having magnetic properties;

(b) a levitating body having a plurality of semi-transparent side walls receiving and reflecting light from the light source to produce visual decorating displays, the body having at least one magnetic element interacting with the magnetic properties of the base to enable the body to levitate over the base, wherein the body has an aperture receiving and distributing light inside the body, the plurality of semi-transparent side walls reflecting and refracting the light throughout the body, the body has a bottom surface including the aperture, the semitransparent side walls connected to the bottom surface, the side walls taper away from the bottom surface and terminate with an apex having an aperture receiving a plurality of light strands, and the light strands collect light inside the body and extend through the aperture of the apex and guiding the light.

* * * * *